US007186956B2

(12) United States Patent
Chae

(10) Patent No.: US 7,186,956 B2
(45) Date of Patent: Mar. 6, 2007

(54) FUSER-CONTROLLING APPARATUS FOR GENERATING A POWER SYNCHRONIZATION SIGNAL AND DETECTING POWER VOLTAGE

(75) Inventor: Young-min Chae, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/143,571

(22) Filed: Jun. 3, 2005

(65) Prior Publication Data

US 2005/0271412 A1 Dec. 8, 2005

(30) Foreign Application Priority Data

Jun. 3, 2004 (KR) ..... 10-2004-0040229

(51) Int. Cl.
*H05B 1/02* (2006.01)

(52) U.S. Cl. ..... 219/497; 219/501; 219/216; 219/505; 323/901; 399/69

(58) Field of Classification Search ..... 219/494, 219/497, 216, 505, 492, 483–486, 501; 323/901, 323/69; 355/401, 405; 399/69
See application file for complete search history.

(56) References Cited

U.S. PATENT DOCUMENTS 5,101,232 A * 3/1992 Evans et al. ..... 399/160
6,018,151 A * 1/2000 Hirst ..... 219/497
6,111,230 A * 8/2000 Cao et al. ..... 219/501
6,947,683 B2 * 9/2005 Na ..... 399/67
2001/0020610 A1 * 9/2001 Yoshimura ..... 219/216

FOREIGN PATENT DOCUMENTS

| | | |
|---|---|---|
| JP | 10-055122 | 2/1988 |
| JP | 11-095606 | 4/1999 |
| JP | 2002-063981 | 2/2002 |
| JP | 2003-111383 | 4/2003 |
| KR | 1987-0000894 | 7/1986 |

* cited by examiner

*Primary Examiner*—Mark Paschall
(74) *Attorney, Agent, or Firm*—Roylance, Abrams, Berdo & Goodman, LLP

(57) ABSTRACT

A fuser-controlling apparatus for generating a power synchronization signal and detecting a power voltage. The fuser-controlling apparatus comprises a power synchronization signal generation circuit for outputting a power synchronization signal for synchronizing fuser operations with a power voltage, a power voltage detection circuit for detecting a level of the power voltage and for outputting a level of the power voltage, and a control unit for controlling a voltage to the fuser in a phase control manner based on the power synchronization signal and the detected level of the power voltage. The fuser-controlling apparatus can produce a power synchronization signal at the zero-crossing points of the power voltage regardless of the levels and frequencies of the power voltage. Accordingly, the fuser-controlling apparatus can instantaneously perform phase and power controls based on such a power synchronization signal, resulting in improvements to the power factor and flicker characteristics of the system.

9 Claims, 9 Drawing Sheets

INPUT VOLTAGE: 220V, 60HZ

Input Voltage: 220V, 50Hz (B) Waveforms Upon Control With A Phase Angle Of 90 Degrees (1) Power Voltage (2) Voltage To Fuser (3) Voltage At Triac Gate (4) Synchronization Signal (A) Waveforms Upon Control With A Phase Angle Of 10 Degrees

FUSER-CONTROLLING APPARATUS FOR GENERATING A POWER SYNCHRONIZATION SIGNAL AND DETECTING POWER VOLTAGE

CROSS-REFERENCE TO RELATED APPLICATIONS

This application claims the benefit under 35 U.S.C. § 119(a) of Korean Patent Application No. 2004-40229, filed in the Korean Intellectual Property Office on Jun. 3, 2004, the entire contents of which are incorporated herein by reference.

BACKGROUND OF THE INVENTION

1. Field of the Invention

The present invention relates to a fuser-controlling apparatus. More particularly, the present invention relates to a fuser-controlling apparatus for generating a power synchronization signal regardless of the levels and frequencies of an applied power voltage, instantaneously carrying out power and phase controls, and controlling power to a fuser according to a detected level of the applied power voltage.

2. Description of the Related Art

The image-forming apparatus is a device for printing images on a recording medium such as paper, corresponding to original image data input. These devices include printers, photocopiers, facsimile machines, and so on.

Such an image-forming apparatus is necessarily provided with a device for keeping heat at a certain temperature in order to enable normal print jobs. In particular, a fuser is provided and has its surface continuously heat-maintained at an appropriate target temperature to fix toner images on paper.

FIG. 1 is a block diagram for illustrating a fuser-controlling apparatus of a conventional image-forming apparatus.

In FIG. 1, the conventional fuser-controlling apparatus 70 has a power input unit 20, a fuser-controlling circuit 30, and a main controller 40.

The switching mode power supply (SMPS) 10 of FIG. 1 is also provided and converts the AC power externally input to the power input unit 20 into a voltage of a certain level needed in the image-forming apparatus.

A temperature sensor (not shown) detects the temperature of a heater 60 installed in the fuser 50, and outputs the detected temperature to the main controller 40, so as to enable the main controller 40 to detect the temperature of the heater 60.

The main controller 40 controls the functions of the entire system, such as warming-up time, temperature upon warming-up, temperature upon printing, and so on. Further, the main controller 40 receives an output signal of the temperature sensor, and outputs a high or low signal to a transistor TR1 in order to increase or maintain a certain temperature at the heater 60, so as to control the temperature.

The base of transistor TR1 is connected to an output terminal of the main controller 40 so as to be switched according to the high or low signal output from the main controller 40.

The fuser-controlling circuit 30 has an optical coupler 35 therein, and the optical coupler 35 has a photo triac P-TRIAC1 and a triac TRIAC1. The photo triac P-TRIAC1 causes a light-emitting element 33B to emit light, operating with the switching of the transistor TR1. One end of the light-emitting element 33B is connected to the collector of the transistor TR1 in order for the transistor TR1 to switch a light-receiving element 33A on via the light-emitting element 33B.

Once the light-receiving element 33A is turned on, electric current is applied to the gate of the triac TRIAC1, so that the triac TRIAC1 is triggered and AC power is then applied to the fuser 50.

The photo triac P-TRIAC1 activates at the point where a power voltage crosses a zero point, thereby improving a power factor and reducing surge current. The triac TRIAC1 is therefore, also turned on at a point where the power voltage crosses a zero point and then the AC power is applied to the fuser 50.

In the conventional fuser-controlling circuit operating as above, the main controller does not have information regarding an input power voltage, but turns on the triac at a point wherein a power voltage crosses a zero point. Thus, if the main controller does not have information of a synchronization angle of power voltage, a problem occurs since it is difficult to improve the flicker characteristics due to irregular turn-on points.

Further, instantaneous power control is essential to satisfy regulations regarding the flickering due to the power consumption change rates. As noted above, since the instantaneous power control becomes impossible without information of an input power voltage phase, it is difficult to improve the flicker characteristics. In particular, problems exist when there is no phase information of an input power voltage. That is, turn-on angle control using the triac becomes impossible, as well as power-factor control, even upon controlling a chopping circuit using high-frequency switching elements.

Further, if the variation values of power consumption are not minimized through the instantaneous power control in the case of devices consuming significant thermal energy, such as high-speed and large-scale laser printers or photocopiers, it is difficult to satisfy regulations regarding flicker. It is therefore, a necessity to detect input power phases for such instantaneous power controls.

Further, for circuits typically used for detecting a synchronization angle of such a power voltage, the circuits detect a synchronization angle based on the level of a voltage or detect frequency information. However, a problem exists with such circuits since different circuits are applied depending on the existing power environments.

Accordingly, a need exists for a system and method for evaluating input power and providing substantially instantaneous power control of devices, such as a fuser.

SUMMARY OF THE INVENTION

The present invention has been developed in order to solve the above and other problems associated with the conventional arrangements. An aspect of the present invention is to provide a fuser-controlling apparatus for generating a power synchronization signal regardless of the levels and frequencies of an applied power voltage, carrying out substantially instantaneous power and phase controls, and controlling power to a fuser according to a detected level of the power voltage.

The foregoing and other objects and advantages are substantially realized by providing a fuser-controlling apparatus comprising a power synchronization signal generation circuit for outputting a power synchronization signal for synchronizing fuser operations with a power voltage, a power voltage detection circuit for detecting a level of the power voltage and for outputting the level of the power voltage, and a control unit for controlling a voltage to the fuser in a phase control manner based on the power synchronization signal and the detected level of the power voltage.

In the exemplary embodiments of the present invention, the power synchronization signal is preferably generated at zero-crossing points of the power voltage.

The fuser-controlling apparatus preferably further comprises a rectification unit for rectifying the power voltage to generate a rectified voltage, and for outputting the rectified voltage to the power synchronization signal generation circuit and the power voltage detection circuit.

The fuser-controlling apparatus preferably further comprises a triac driver for controlling a phase of the power to the fuser based on the power synchronization signal.

In the exemplary embodiments of the present invention, the power synchronization signal generation circuit preferably includes a filter unit for filtering the rectified voltage to a predetermined level and for outputting the filtered voltage, and a first photocoupler for emitting a light signal to turn on a photo transistor when the level of the filtered voltage is over a predetermined reference level, and for turning off the photo transistor when the level of the filtered voltage is below the predetermined reference level. A power synchronization signal generation unit is also provided for inverting a voltage of a predetermined level that is generated by the turning-on or turning-off of the photo transistor, and for generating and outputting a power synchronization signal for synchronizing fuser operations with the power voltage at zero-crossing points of the power voltage.

The power voltage detection circuit also preferably includes a power voltage level sensor for sensing a level of the power voltage by the use of a plurality of Zener diodes turning on depending on a level of the rectified voltage input from the rectification unit, and a second photo coupler for turning on and off a photo transistor according to the sensed level of the power voltage. A power voltage detector is then provided for detecting the power voltage of a predetermined level that is output according to the turning-on or turning-off of the photo transistor.

BRIEF DESCRIPTION OF THE DRAWINGS

The above aspects and features of the present invention will become more apparent by describing certain embodiments of the present invention with reference to the accompanying drawings, in which.

Throughout the drawings, like reference numerals will be understood to refer to like parts, components and structures.

DETAILED DESCRIPTION OF THE EXEMPLARY EMBODIMENTS

Figure 1:
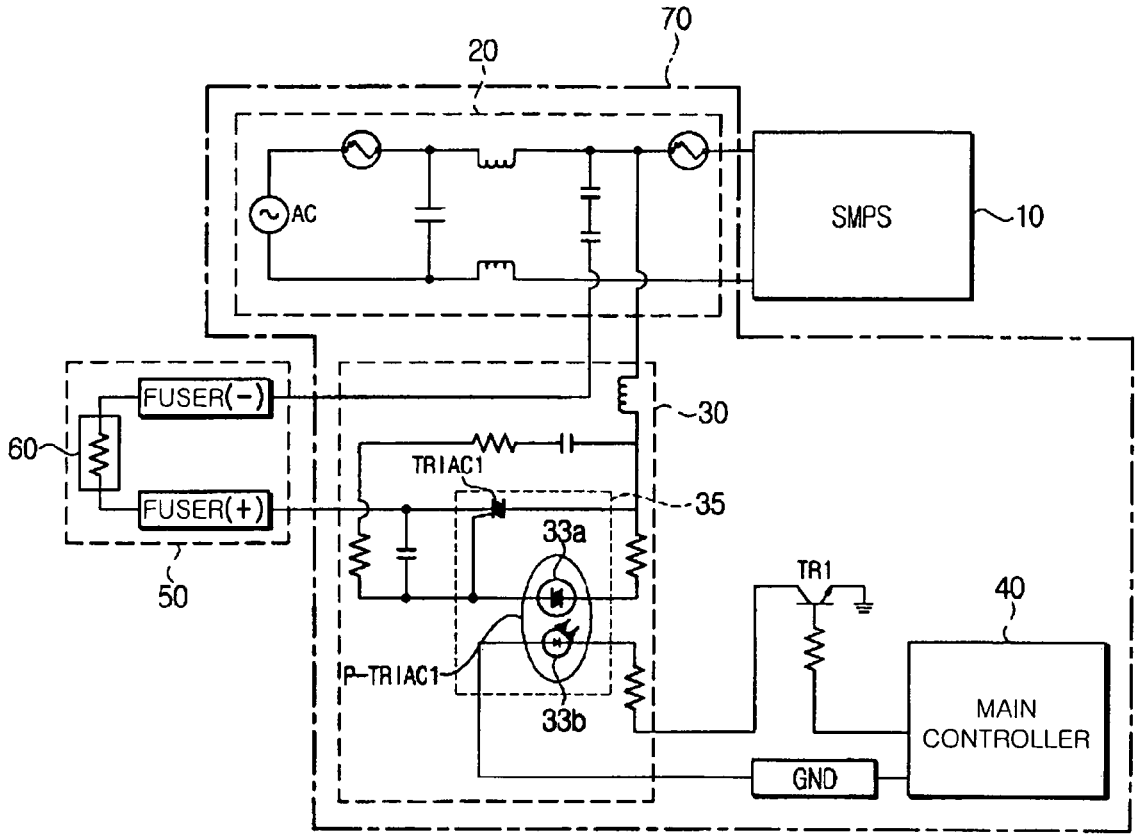
FIG. 1 (PRIOR ART)
FIG. 1 is a block diagram for illustrating a fuser-controlling apparatus of a conventional image-forming apparatus.

Hereinafter, exemplary embodiments of the present invention will be described with reference to the accompanying drawings.

In the following descriptions, same drawing reference numerals are used for the same elements even in different drawings. The matters defined in the description, such as detailed construction and element descriptions, are provided to assist in a comprehensive understanding of the invention. Also, well-known functions or constructions are not described in detail since they would obscure the invention in unnecessary detail.

Figure 2:
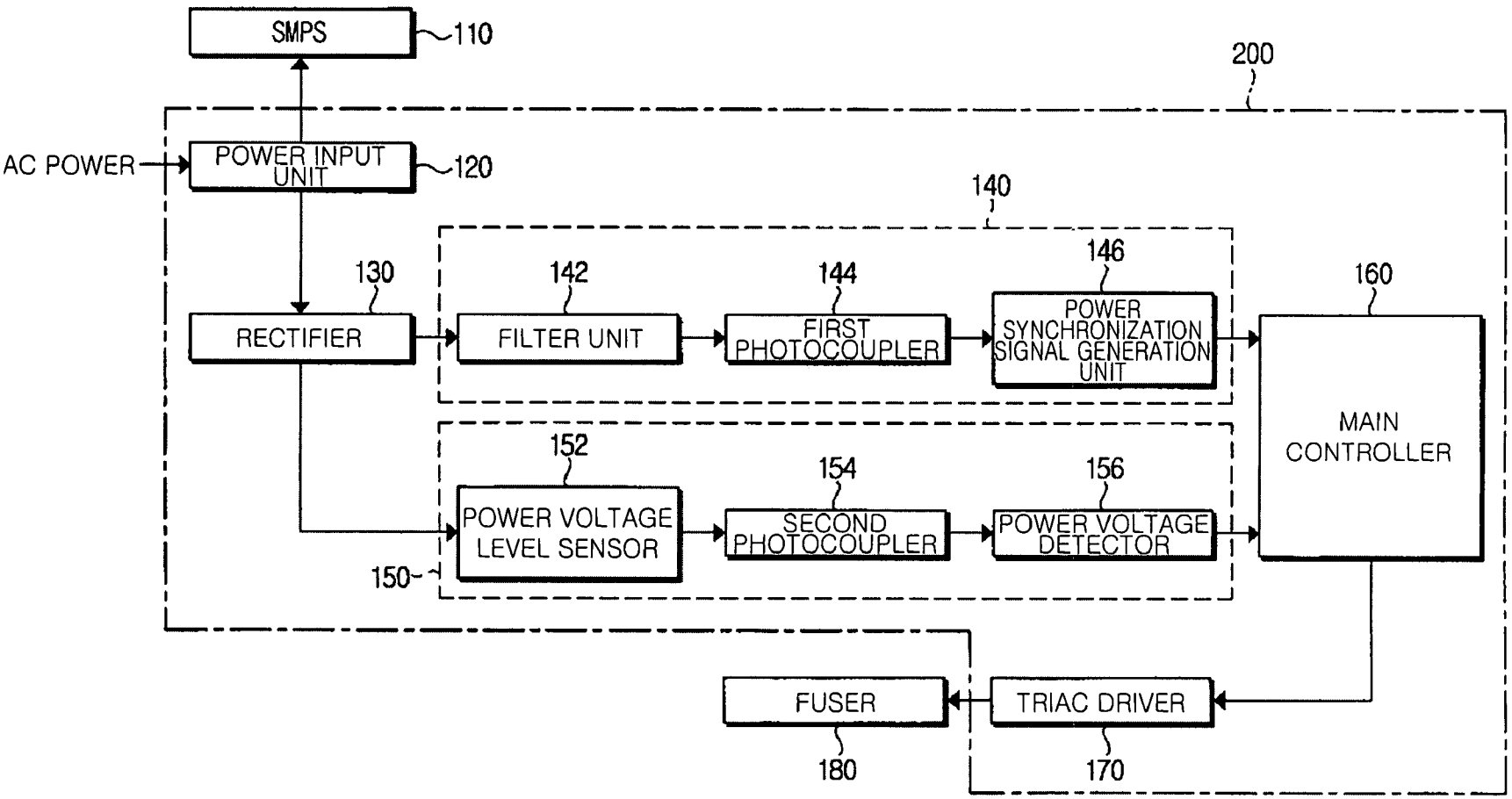
FIG. 2 is a block diagram for illustrating a structure of a fuser-controlling apparatus according to an embodiment of the present invention.

FIG. 2 is a block diagram for illustrating a structure of a fuser-controlling apparatus according to an embodiment of the present invention.

In FIG. 2, a fuser-controlling apparatus 200 according to an exemplary embodiment of the present invention has a power input unit 120, a rectifier 130, a power synchronization signal generation circuit 140, a power voltage detection circuit 150, a main controller 160, and a triac driver 170.

The switching mode power supply (SMPS) 110 converts an AC voltage externally input to the power input unit 120 into a voltage of predetermined level needed in an image-forming apparatus, and the AC voltage from the power input unit 120 is supplied to the rectifier 130. The rectifier 130 consists of a plurality of diodes, and rectifies the AC power voltage supplied from the power input unit 120 into a DC voltage.

The power synchronization signal generation circuit 140 has a filter unit 142, a first photocoupler 144, and a power synchronization signal generation unit 146. The power synchronization signal generation unit 146 detects a synchronization angle regardless of the levels and frequencies of a power voltage, and generates a synchronization signal at every zero-crossing point.

A filter unit 142 consists of a plurality of resistors and capacitors, and filters for an output DC voltage rectified by the rectifier 130. The first photocoupler 144 includes a light-emitting element such as a photo diode, and a light-receiving element such as a photo transistor. The light-emitting element and light-receiving element of the first photocoupler 144 are electrically isolated.

The power synchronization signal generation unit 146 includes a plurality of resistors, at least one transistor, and at least one NOR gate element. The NOR gate element operates as an inverter, and converts an analog voltage signal into a digital pulse output through an inverting process. A high-level pulse is output every time the power voltage crosses a zero point, and a low-level pulse is output beyond the zero points. The power synchronization pulse generated by the power synchronization signal generation unit 146 is sent to the main controller 160. The main controller 160 then carries out phase controls based on the received power synchronization signal.

The power voltage detection circuit 150 has a power voltage level sensor 152, a second photocoupler 154, and a power voltage detector 156.

The power voltage level sensor 152 consists of a plurality of resistors, a plurality of Zener diodes, and a plurality of capacitors. The second photocoupler 154 has a light-emitting element consisting of a photo diode, and a light-receiving element consisting of a photo transistor, as in the first photocoupler 144. The second photocoupler 154 also serves to electrically isolate the power voltage level sensor 152 from the power voltage detector 156. Specifically, the photo diode emits light to turn on the photo transistor only if a voltage over a predetermined level is applied by the power voltage level sensor 152 to the photo diode.

The power voltage detector 156 detects whether the power voltage is at a predetermined level (such as 110V or 220V), based on the turning-on or turning-off of the photo diode, and the detection information is then sent to the main controller 160. The main controller 160 then controls the fuser 180 according to the level of the power voltage.

Figure 3:
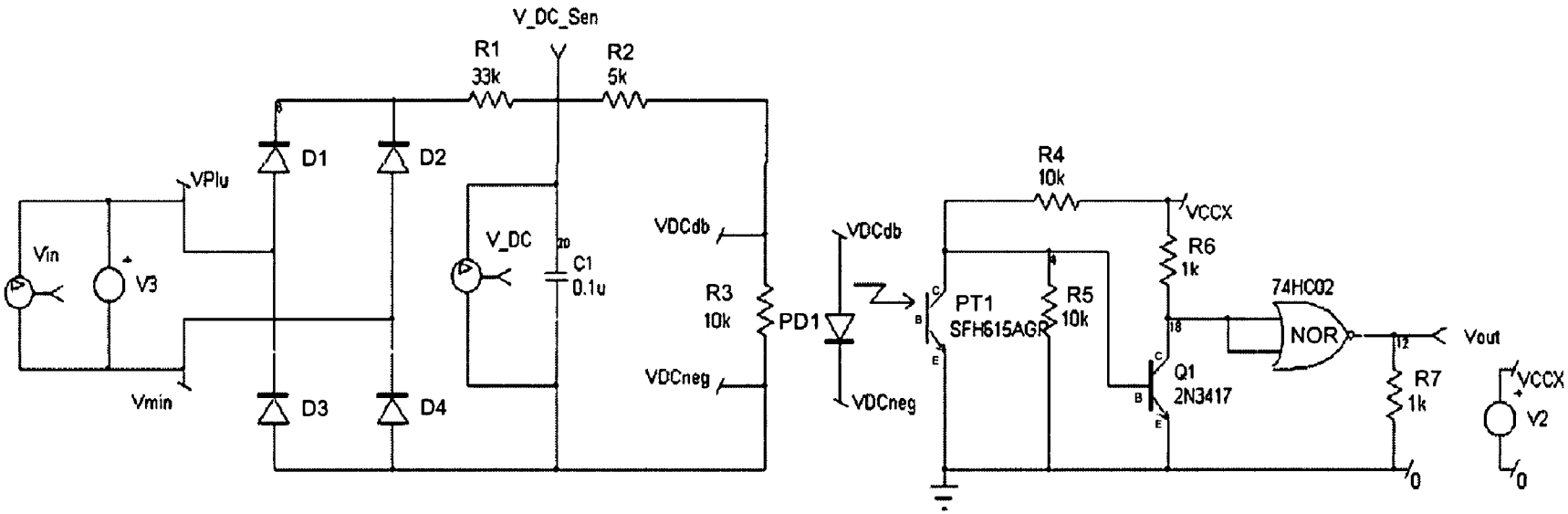
FIG. 3 is a view for illustrating a simulation circuit for a power synchronization signal generation circuit of FIG. 2.
Figure 4A:
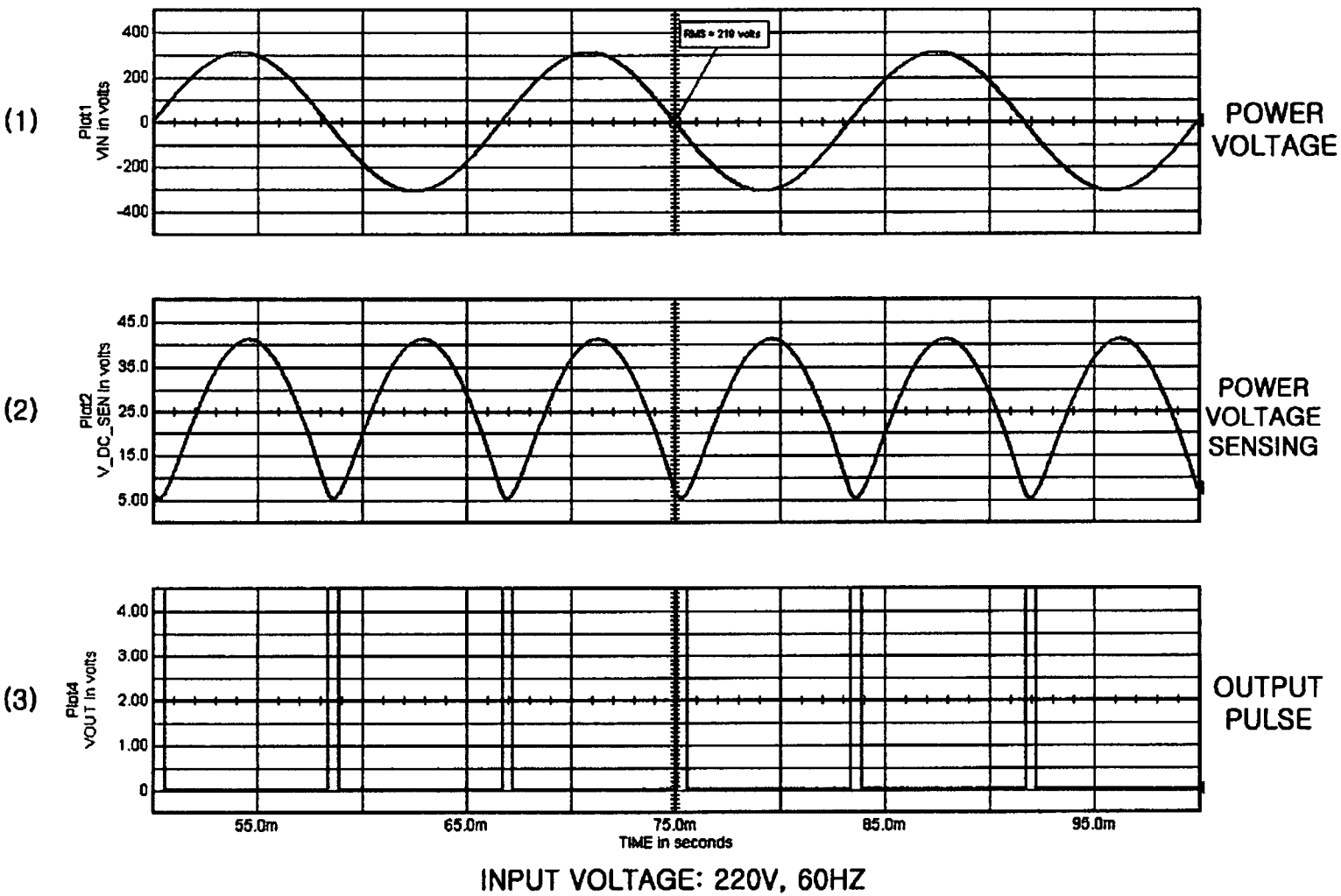
FIG. 4A to FIG. 4D are plots for illustrating output waveforms as frequencies vary with voltages of 220V and 110V, respectively, applied as an input voltage of FIG. 3.
Figure 4B:
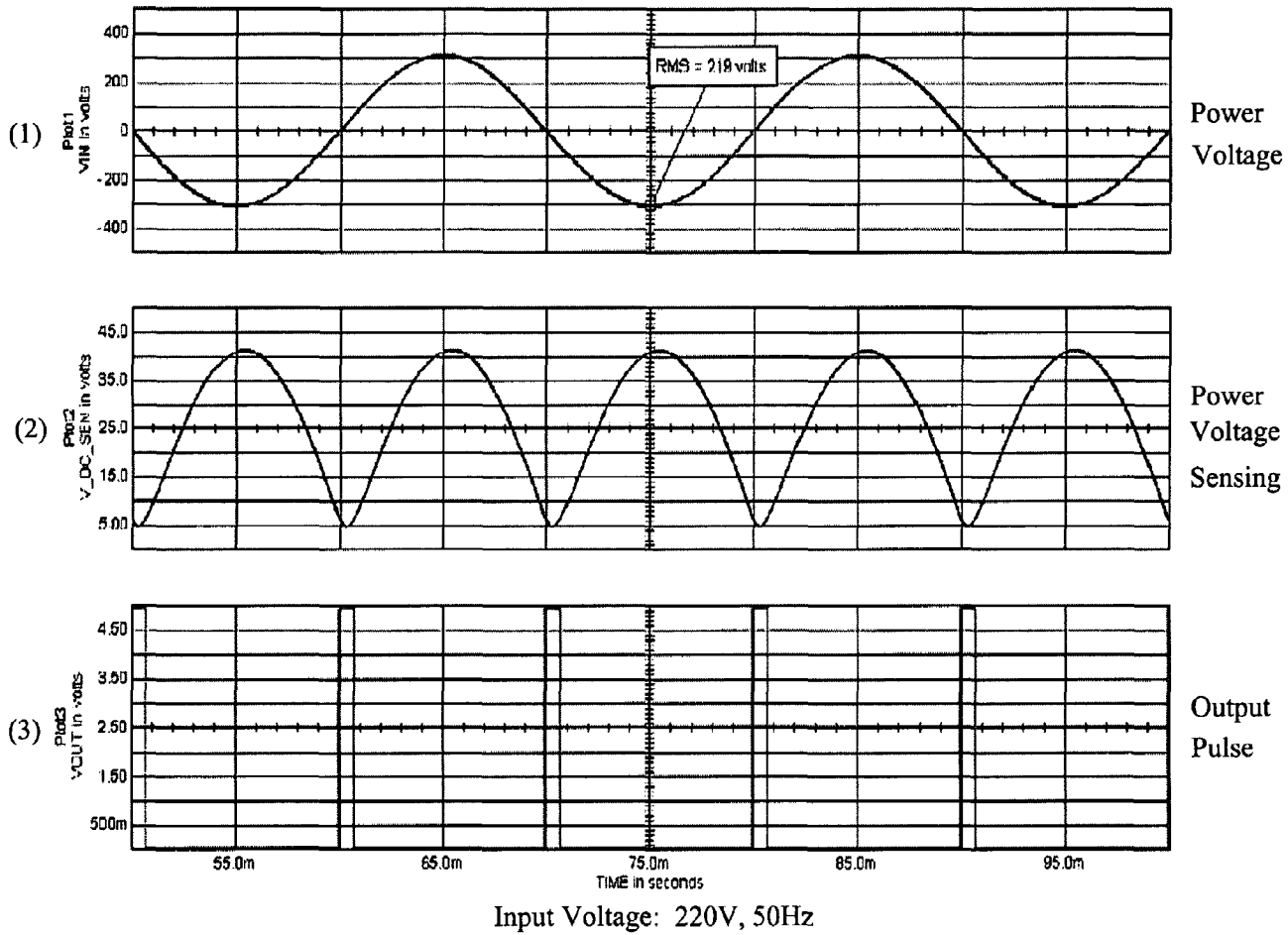
Figure 4C:
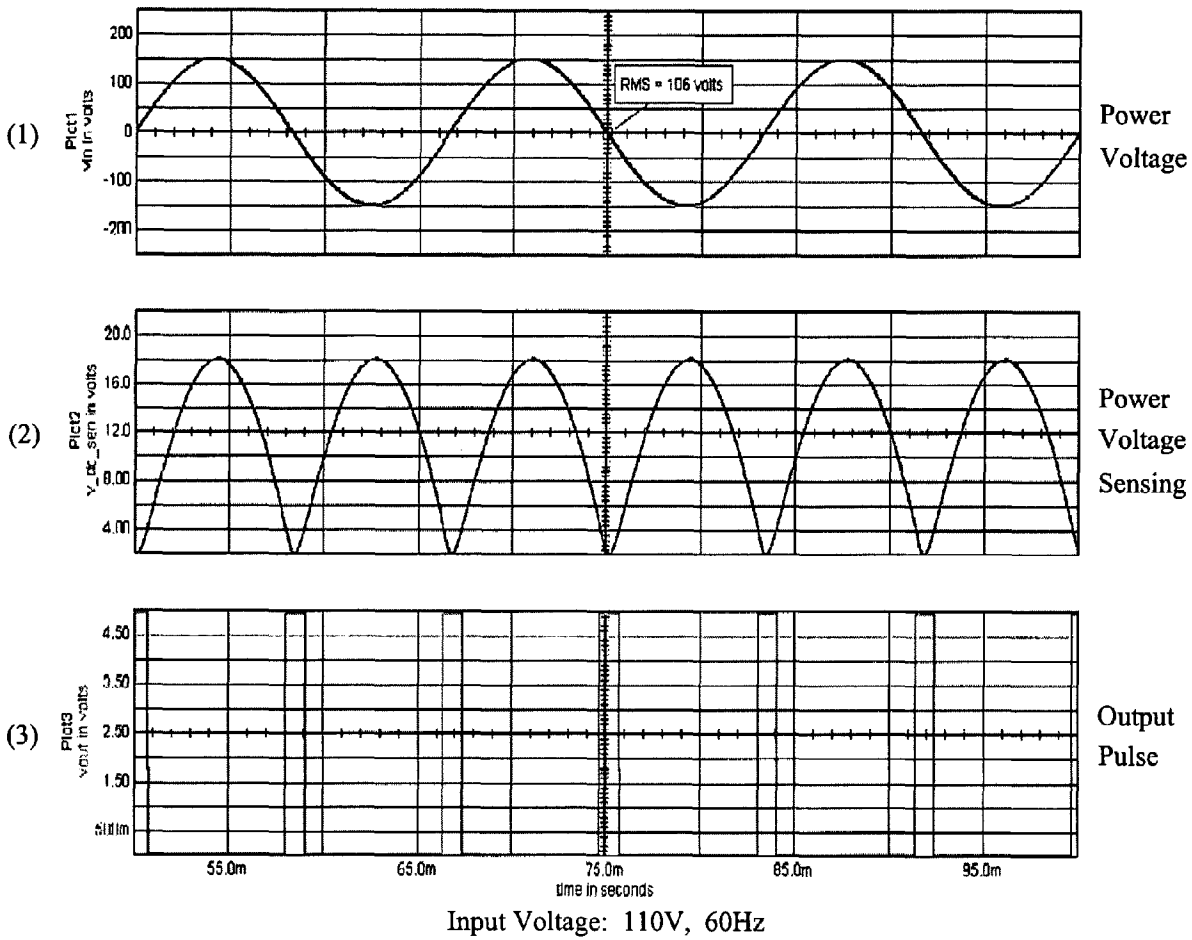
Figure 4D:
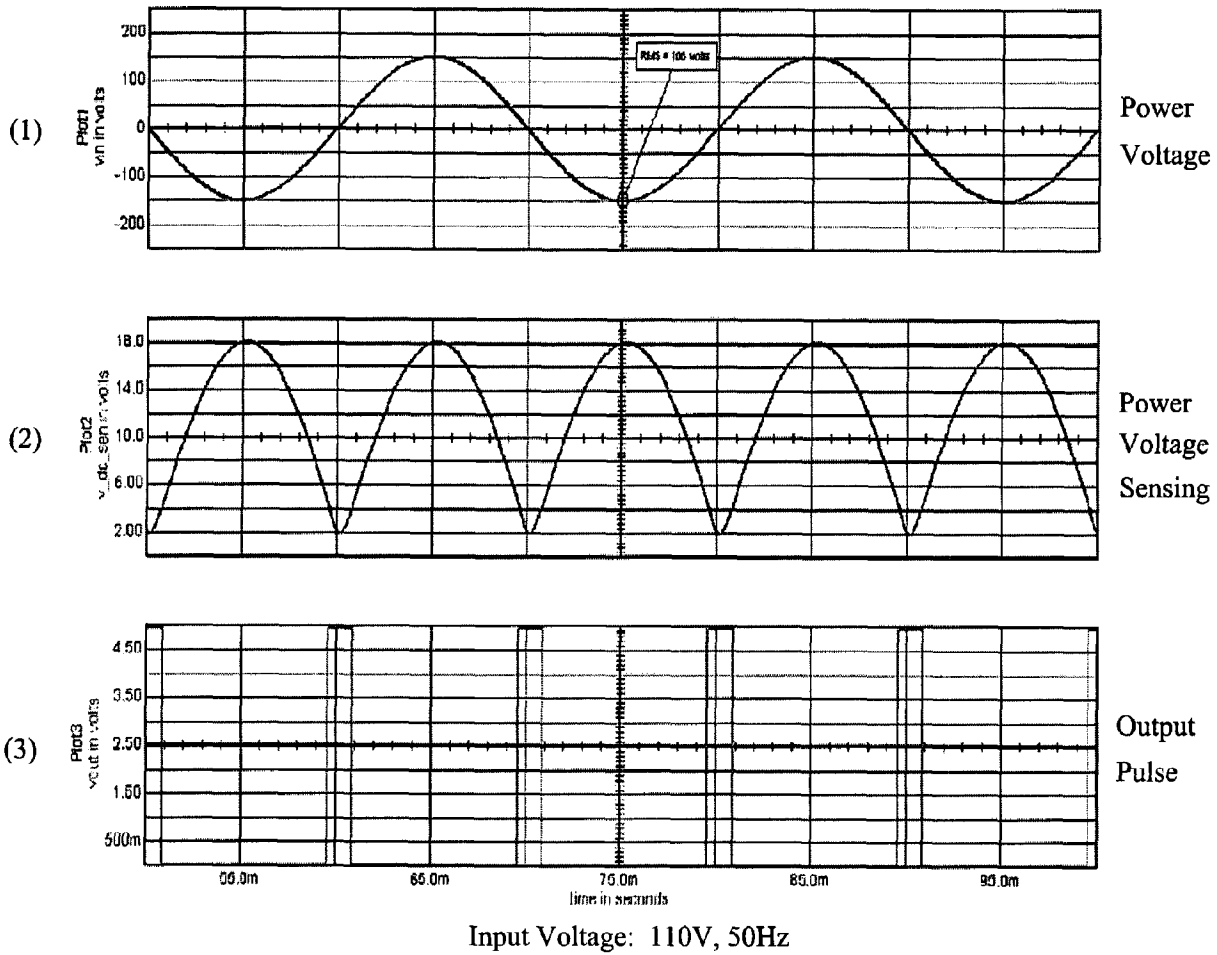

FIG. 3 is a view for illustrating a simulation circuit of the power synchronization signal generation circuit 140 of FIG. 2, and FIG. 4 shows output waveforms according to the frequency variations when 220V and 110V are applied as the input voltage of FIG. 3.

In FIG. 3, the AC power $V_{in}$ is input to the power input unit 120 (refer to FIG. 2) and is then rectified by the rectifier 130 including a plurality of diodes D1 to D4.

The rectified voltage is then filtered to a predetermined level by the filter unit 142 including a plurality of resistors and capacitors. The first and second resistors R1 and R2 are used to properly distribute a voltage applied to the light-emitting element PD1 of the first photocoupler 144.

If a low-level voltage is applied to the third resistor R3 connected in parallel with the light-emitting element PD1 of the first photocoupler 144, light is not emitted to the light-receiving element, or first photo transistor PT1, from the light-emitting element PD1 of the photocoupler, and the photo transistor PT1 is not turned on. Since the first photo transistor PT1 is not turned on, a high-level voltage is applied to the base B of the first transistor Q1, which is connected to the collector C of the first photo transistor PT1, so the first transistor Q1 is turned on. Thus, with the first transistor Q1 turned on, a low-level voltage is input to the NOR gate device, operating as an inverter, such that the NOR-gate device outputs a high-level voltage as a final voltage Vout.

Referring to plot (2) of FIGS. 4A to 4D, a rectified waveform is generated so that the waveform can have the minimum value at the zero-crossing points of the input power voltage shown in plot (1) of FIGS. 4A to 4D. FIG. 4A to FIG. 4D are plots for illustrating output waveforms as frequencies and voltages vary. Plot (1) of each illustrates power voltage, plot (2) of each illustrates power voltage sensing, and plot (3) of each illustrates the output pulse. If a low-level voltage of a rectified waveform is applied to the light-receiving element of the first photocoupler 144 via the above operation process, the final output waveform is output as a high-level pulse.

In contrast, if a high-level voltage of a rectified waveform is applied to the third resistor R3, the photo diode PD1 emits light so that the photo transistor PT1 is turned on. Thus, a low-level voltage is applied to the base B of the first transistor Q1, which is connected to the collector C of the photo transistor PT1, such that the first transistor Q1 is not turned on. Accordingly, a high-level voltage is applied to the NOR gate device, operating as an inverter, and the final output waveform is output as a low-level pulse.

In this example, the voltage waveform at the point V2 of FIG. 3 is a waveform as shown in plot (2) of FIGS. 4A to 4D. The waveform can be shown to have a minimum value at the zero-crossing points of the input power voltage $V_{in}$ as shown in plot (1) of FIGS. 4A to 4D.

Further, the filtered voltage causes the light-emitting element PD1 of the first photocoupler 144 to emit light to the light-receiving element PT1 of the first photocoupler.

In FIGS. 4A to 4D, it can be shown that a final output pulse of plot (3) is regularly generated at the zero-crossing points of the power voltage of plot (1), regardless of the levels and frequency variations of the voltage 110V or 220V, when compared to the power voltage signal.

Figure 5:
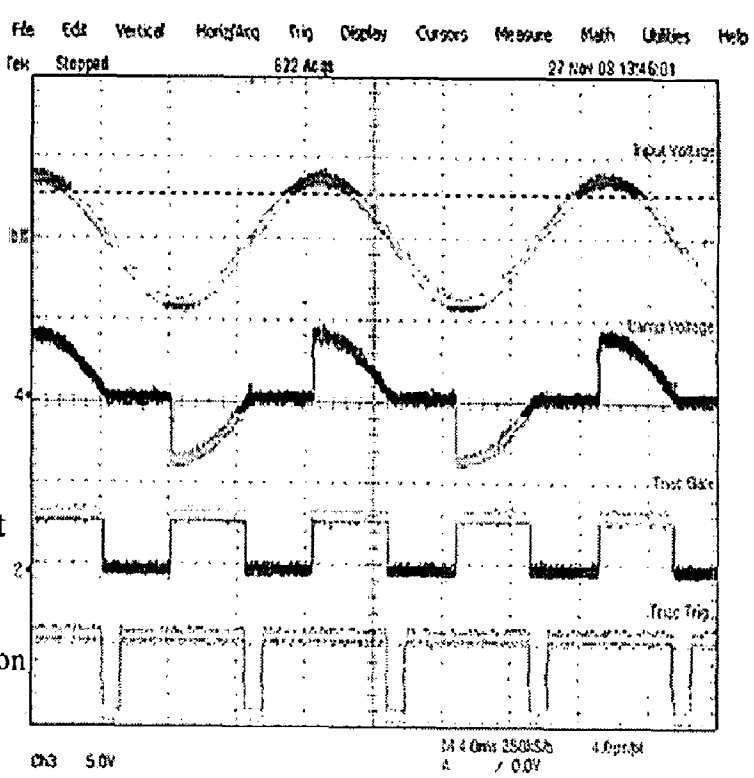
FIG. 5 is a view of plots (A) and (B) for illustrating output waveforms when phase controls have been carried out by the use of a fuser-controlling apparatus according to an embodiment of the present invention.
Figure 5:
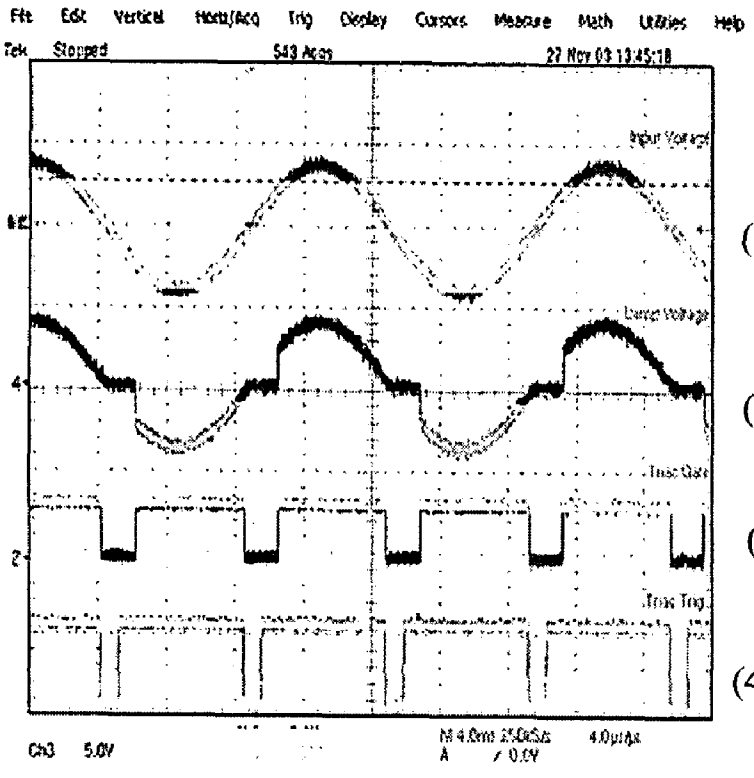

FIG. 5 includes plots (A) and (B) for illustrating output waveforms resulting from phase controls using the fuser-controlling apparatus according to an embodiment of the present invention. In FIG. 5, the main controller 160 controls phase angles by controlling a signal applied to the gate of the triac for the fuser via the triac driver 170, based on a reference signal with respect to the phase of the power voltage which is generated at the zero-crossing point of the power voltage. The plot (A) of FIG. 5 shows waveforms appearing for the power voltage (1), voltage to fuser (2), voltage at the triac gate (3), and the synchronization signal (4), when the phase angle controls have been performed with a phase angle of about 10 degrees, and the plot (B) of FIG. 5 shows waveforms appearing when the phase angle controls have been performed with a phase angle of about 90 degrees.

Figure 6:
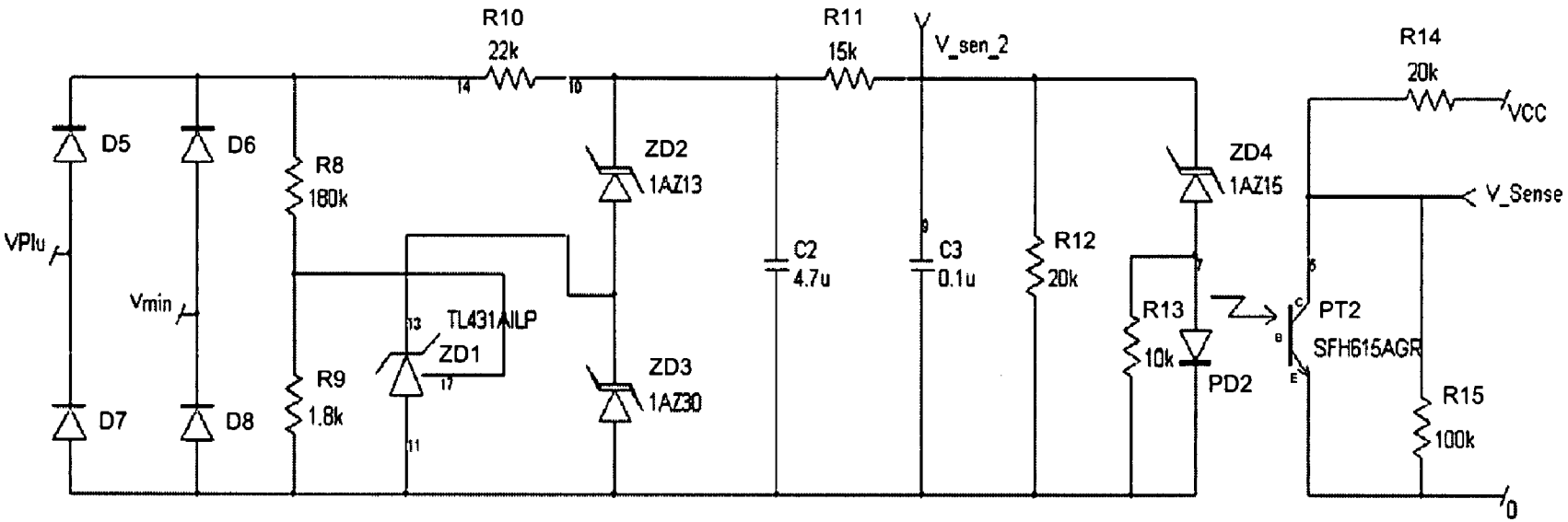
FIG. 6 is a view for illustrating a simulation circuit for the power voltage detection circuit of FIG. 2.

FIG. 6 is a view for illustrating a simulation circuit for the power voltage detection circuit 150 shown in FIG. 2.

In FIG. 6, the power voltage is rectified through a plurality of diodes, divided into certain voltages by the eighth and ninth voltage division resistors R8 and R9, and then applied to the first Zener diode ZD1.

If a power voltage of 220V is applied to the power voltage detection circuit 150 through the rectifier 130, the first Zener diode ZD1 is turned on and produces a voltage drop across the second Zener diode ZD2, such that a voltage applied to the second capacitor C2 then turns into a low level voltage, wherein the second capacitor C2 is connected in parallel to the second and third Zener diodes ZD2 and ZD3.

Therefore, since the low-level voltage is also applied to the fourth Zener diode ZD4, the fourth Zener diode ZD4 is not turned on, such that the second photo diode PD2 does not emit light to the second photo transistor PT2 of the second photocoupler 154. Accordingly, the second photo transistor PT2 is not turned on, and a high-level voltage is applied to the main controller 160 through an output terminal of the second photo transistor PT2. Therefore, the main controller 160 recognizes that the level of the power voltage is 220V.

If a power voltage of 110V is applied to the power voltage detection circuit 150 through the rectifier 130, the first Zener diode ZD1 applies a low-level output signal to the junction of the second and third Zener diodes ZD2 and ZD3. Thus, no voltage drop is produced across the second Zener diode ZD2, so a high-level voltage is applied to the second capacitor C2.

Accordingly, the fourth Zener diode ZD4 is turned on and light is emitted from the second photo diode PD2 to the second photo transistor PT2, by which, the second photo transistor PT2 is turned on and the low-level voltage is applied to the main controller 160 of FIG. 2 through the output terminal of the second photo transistor PT2. Therefore, the main controller 160 recognizes that the level of the power voltage is As implemented in the above exemplary embodiments, since the main controller 160 can recognize the level of the power voltage, the power to the fuser 180 can be controlled depending on the level of the power voltage.

As described above, the fuser-controlling apparatus according to the present invention can produce a power synchronization signal at the zero-crossing points of the power voltages regardless of the levels and frequencies of the power voltage. Accordingly, the fuser-controlling apparatus can substantially instantaneously perform phase and power controls based on such a power synchronization signal, resulting in improvements to the power factor and flicker characteristics of the system.

Further, the fuser-controlling apparatus according to the present invention enables the main controller to recognize the level of the power voltage, providing an advantage of controlling power to the fuser depending on the levels of the power voltage. Accordingly, the temperature of the fuser can be controlled by the use of the same circuit and fuser, regardless of the levels of the power voltage which may vary depending on place and time, so that the interoperability of fusers can increase for laser printers and photocopiers.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A fuser-controlling apparatus, comprising:

a power synchronization signal generation circuit for outputting a power synchronization signal for synchronizing a fuser operation with a power voltage;

a power voltage detection circuit for sensing a level of the power voltage and for outputting a detected level of the power voltage;

a rectification unit for rectifying the power voltage to generate a rectified DC voltage, and for outputting the rectified DC voltage to the power synchronization signal generation circuit and the power voltage detection circuit; and a control unit for controlling a voltage applied to a fuser in a phase control manner based on the power synchronization signal and the detected level of the power voltage.

2. The fuser-controlling apparatus as claimed in claim 1, wherein:

the power voltage comprises a waveform having a plurality of zero-crossing points, and wherein the power synchronization signal is generated at the zero-crossing points of the power voltage waveform independent of voltage levels and frequency variations.

3. The fuser-controlling apparatus as claimed in claim 1, further comprising a triac driver for controlling a phase of a power voltage to the fuser based on the power synchronization signal.

4. The fuser-controlling apparatus as claimed in claim 1, wherein the power synchronization signal generation circuit comprises:

a filter unit for filtering the rectified voltage to a predetermined level and for outputting the filtered voltage;

a first photocoupler for emitting a light signal to turn on a first photo transistor when the level of the filtered voltage is over a predetermined reference level, and for turning off the first photo transistor when the level of the filtered voltage is below the predetermined reference level; and a power synchronization signal generation unit for generating and outputting a power synchronization signal for synchronizing a fuser operation with the power voltage.

5. The fuser-controlling apparatus as claimed in claim 4, wherein:

the power voltage comprises a waveform having a plurality of zero-crossing points, and wherein the power synchronization signal synchronizes a fuser operation with the power voltage at the zero-crossing points of the power voltage waveform by inverting a voltage of a predetermined level that is generated by the turning-on or turning-off of the first photo transistor.

6. The fuser-controlling apparatus as claimed in claim 1, wherein the power voltage detection circuit comprises:

a power voltage level sensor for sensing a level of the power voltage by use of a plurality of Zener diodes;

a second photo coupler for turning on and off a second photo transistor according to the sensed level of the power voltage; and a power voltage detector for detecting the power voltage of a predetermined level according to the turning-on or turning-off of the second photo transistor.

7. The fuser-controlling apparatus as claimed in claim 6, wherein at least one of the plurality of Zener diodes is turned on depending on a level of the rectified voltage input from the rectification unit.

8. A method for controlling a fuser-controlling apparatus, comprising the steps of:

controlling a power synchronization signal generation circuit for receiving a an input power and in response, outputting a power synchronization signal for synchronizing a fuser operation with a power voltage;

controlling a power voltage detection circuit for sensing a level of the input power and in response, outputting a detected level of the input power;

controlling a rectification unit for rectifying the power voltage to generate a rectified DC voltage, and outputting the rectified DC voltage to the power synchronization signal generation circuit and the power voltage detection circuit; and controlling a voltage applied to a fuser in a phase control manner based on the power synchronization signal and the detected level of the input power independent of voltage levels and frequency variations.

9. The method as claimed in claim 8, wherein the power voltage comprises a waveform having a plurality of zero-crossing points, further comprising the step of:

generating the power synchronization signal at the zero-crossing points of the power voltage waveform.

* * * * *